United States Patent [19]

O'Connor et al.

[11] 4,253,570

[45] Mar. 3, 1981

[54] REINFORCED SPOOL FOR STORING AND TRANSPORTING STRAND MATERIAL AND A PACKAGE ASSEMBLY UTILIZING THE SAME

[75] Inventors: James A. O'Connor; Kenneth P. Kiefer, both of Fort Wayne, Ind.

[73] Assignee: Essex Group, Inc., Fort Wayne, Ind.

[21] Appl. No.: 66,193

[22] Filed: Aug. 13, 1979

[51] Int. Cl.[3] ..... B65D 19/32; B65D 19/44; B65D 85/66

[52] U.S. Cl. ..... 206/391; 206/389; 206/597; 206/386; 220/23.4; 242/118.7

[58] Field of Search ..... 206/391, 386, 389, 597, 206/416; 220/23.4; 242/118.7

[56] References Cited

U.S. PATENT DOCUMENTS

| | | | |
|---|---|---|---|
| 6,533 | 7/1875 | Firm | 206/416 |
| 2,843,260 | 7/1958 | Sommer | 206/389 |
| 2,902,234 | 9/1959 | Morin | 242/118.7 |
| 3,131,829 | 5/1964 | Masser | 220/23.4 |
| 3,164,252 | 1/1965 | Hosbein | 206/597 |
| 3,289,972 | 12/1966 | Hafner | 242/118.7 |
| 3,322,373 | 5/1967 | Wilson, Jr. et al. | 242/118.7 |
| 3,334,840 | 8/1967 | Wilson, Jr. et al. | 242/118.7 |
| 3,398,915 | 8/1968 | Dittrich | 242/118.7 |
| 3,591,104 | 7/1971 | Hafner | 242/118.7 |
| 4,161,248 | 7/1979 | Kalmanovitch | 206/389 |

*Primary Examiner*—William T. Dixson, Jr.
*Attorney, Agent, or Firm*—Robert D. Sommer; Lawrence E. Freiburger

[57] ABSTRACT

A spool for storing and transporting heavy strand material, particularly wire, includes a hollow shell with integral legs and reinforcing means in the interior of the shell. In one embodiment, the reinforcing means is a foam filling, which in a second embodiment, the reinforcing means comprises integral braces in the interior of the shell. A cap on the spool allows two or four spools to be banded together in a package assembly. The cap is also configured to permmit stacking of the spools.

3 Claims, 11 Drawing Figures

REINFORCED SPOOL FOR STORING AND TRANSPORTING STRAND MATERIAL AND A PACKAGE ASSEMBLY UTILIZING THE SAME

This invention relates generally to spools for storing and transporting strand material and to a package assembly which utilizes the spool of the invention as an integral part. More specifically, the spool of the invention has integral legs which enable it to be transported by a forklift truck and its structural characteristics enable it to support a heavy quantity of strand material i.e. 1000 pounds or less. Further, the spool has interlocking means which enable it to be incorporated into a package of two or more spools such that the integral legs of the spools function as legs for the package to permit forklift transport of the package.

Spools for storing and transporting strand material are, of course, well known in the prior art. In addition, it is well known to store strand material on an upright metal rack which has legs thereon for transport by a forklift truck. See U.S. Pat. No. 2,843,260.

In addition, it is also well known to construct a spool of a thin shell which is reinforced by a filling of foamed plastic. See U.S. Pat. Nos. 3,322,373 and 3,334,840.

Finally it is well known in the prior art to incorporate a spool of strand material into a package assembly, such that the entire package can be picked up by a fork lift truck for transportation. See U.S. Pat. No. 3,164,252.

The prior art spools although performing satisfactorily for their intended purpose, possess certain disadvantageous features which restrict their use. It is quite clear that with today's high speed equipment (particularly for handling wire) a spool for storing and transporting wire should be capable of storing a large quantity of wire thereon and should also be easily handled so as to hold machine set up times to an absolute minimum. Although metal spools are capable of supporting a substantial amount of weight, the substantial weight of the spool itself does not meet the easy handling criteria. The foam reinforced spools are lightweight and are thus capable of being easily handled. However the plastic spools are limited in their carrying capacity.

The criterion set out above regarding ease of handling has an additional aspect, namely ease of handling in shipping. With prior art metal containers such as shown in the above-described Sommer patent it is necessary to surround the reel with a complicated housing. Plastic spools such as those described in the Wilson Jr. et al patents can be incorporated into a package such as that disclosed in U.S. Pat. No. 3,164,252 for shipping but handling them is still a problem when removed from the package assembly, particularly if a considerable amount of wire is wound thereon.

Applicant's invention is a lightweight plastic spool structure which provides a more optimal tradeoff between the ease of handling criterion and the capacity criterion. More specifically the spool structure of the invention is capable of carrying up to 1000 pounds of wire such as magnet wire, is relatively lightweight in that it is constructed almost entirely of plastic, and further has integral legs which permit it to be transported by a forklift truck. The plastic spool of the invention consists of a one piece reinforced shell which includes a tubular barrel portion and top and bottom flanges of conical configuration. A support member having legs arranged such that a forklift truck can lift the spool extends from the bottom flange. Preferably, the spool is reinforced by a filling of cured plastic foam, but other reinforcing means such as integral braces can be utilized.

The spool of the invention includes interlocking means in the form of tabs and recesses on the support member which serve to locate the spools in ganged side-by-side relationship with one another. In addition, a cap placed on the upper spool flange is designed to interlock with other caps on other spools to locate the top flanges of the packaged spools in ganged side-by-side relation. A banding groove on the edge of the caps and a banding groove on the support member each retain a band therein so that two or four spools can be banded together. When either two or four such spools are banded together, the legs of the individual spools are spaced to receive the blades of a forklift truck to enable the entire package to be transported.

During the course of the description of the preferred embodiment of the invention, reference will be made to the drawings, in which.

Figure 1:
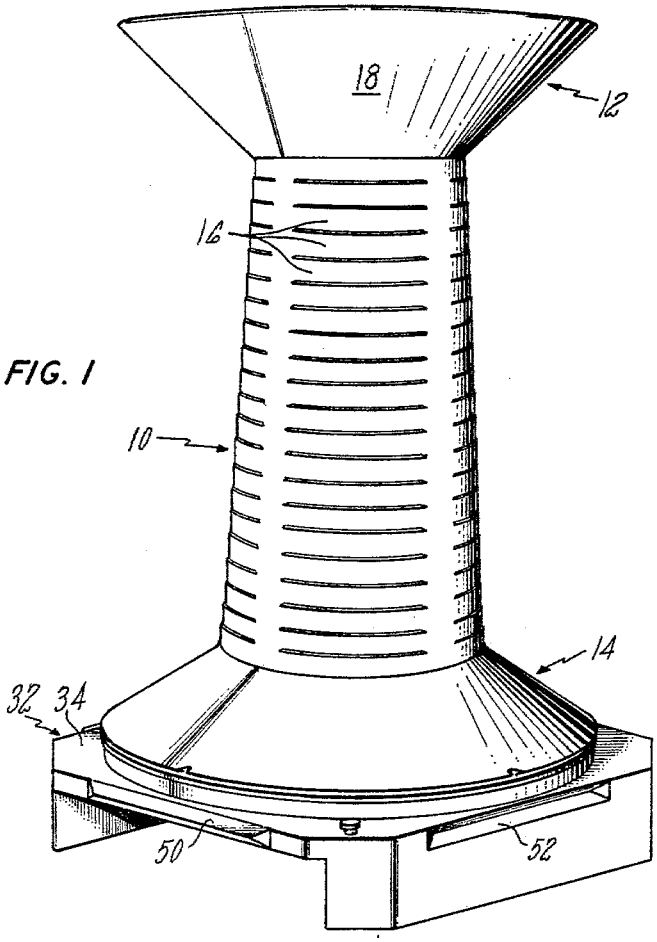
FIG. 1 is a perspective view of a spool in accordance with the present invention.

Referring firstly to FIGS. 1–4, the spool of the invention is comprised of a hollow shell having a tubular, tapered barrel portion 10 and upper and lower flanges 12 and 14, respectively. The barrel portion 10 is formed with a plurality of vertical segments 16 which are progressively stepped inwardly in a direction from bottom to top. The stepped segments 16 are discontinuous around the circumference of the barrel and serve to prevent the first layer of strand material wound upon the barrel from slipping down toward the bottom flange.

As shown in the drawings, upper flange 12 includes a smooth, frusto-conical surface 18 as viewed from the bottom flange. The top of the spool is closed off by a top wall of progressively, radially, inwardly stepped configuration. Thus the top wall includes an outer ring 20 joined to the smooth conical surface 18 at its outer edge; and intermediate ring-like section 22 recessed axially from the outer ring-like section 20 and connected thereto by a vertical wall 24; and finally a central disc portion 26 recessed axially from ring-like portion 22 and connected thereto by a conical wall 28. Accordingly, it will be seen that the top surface of the upper flange is configured to have a pair of coaxial recesses therein, one being cylindrical in shape and the inner one being frustum shaped.

The lower flange 14 is configured in a complimentary fashion to the upper flange, but of a slightly larger diameter. Thus, flange 14 is formed of a conical disc portion 30 extending from the lower end of tubular barrel 10 which has a smooth frusto-conical surface for bearing the weight of strand material wrapped around barrel 10.

A support member for the spool includes a square hollow platform 32 consisting of an upper plate 34 and a base plate 36 parallel thereto. The lower conical disc 30 is supported on the support platform by a support wall 38 including a circular connecting band 40 integral with the upper plate 34, a ridge 42 at the top of the connecting band and a connecting fold 44 between ridge 42 and conical disc 30.

Figure 2:
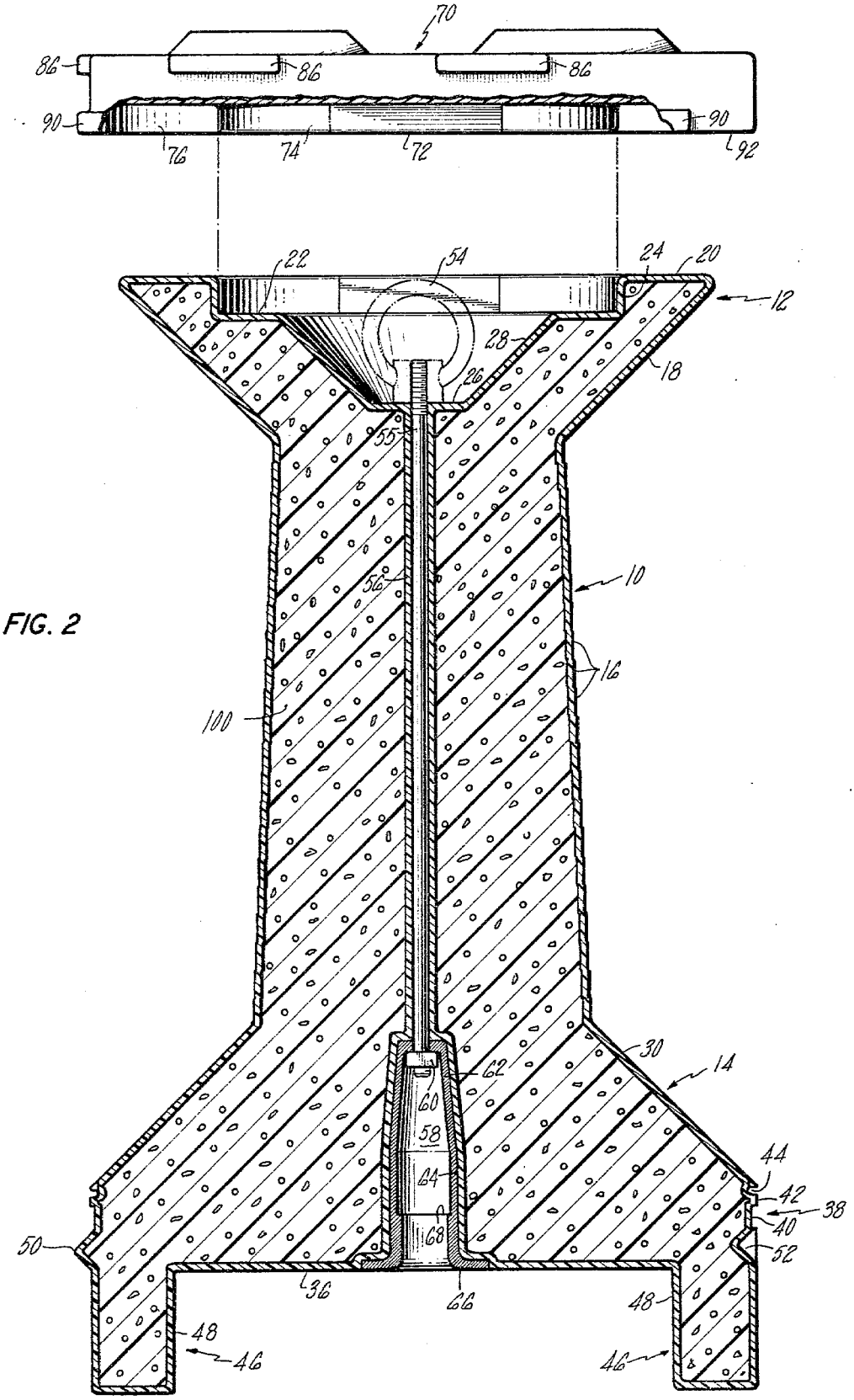
FIG. 2 is a cross sectional view of the spool of FIG. 1 and a cap therefor.
Figure 3:
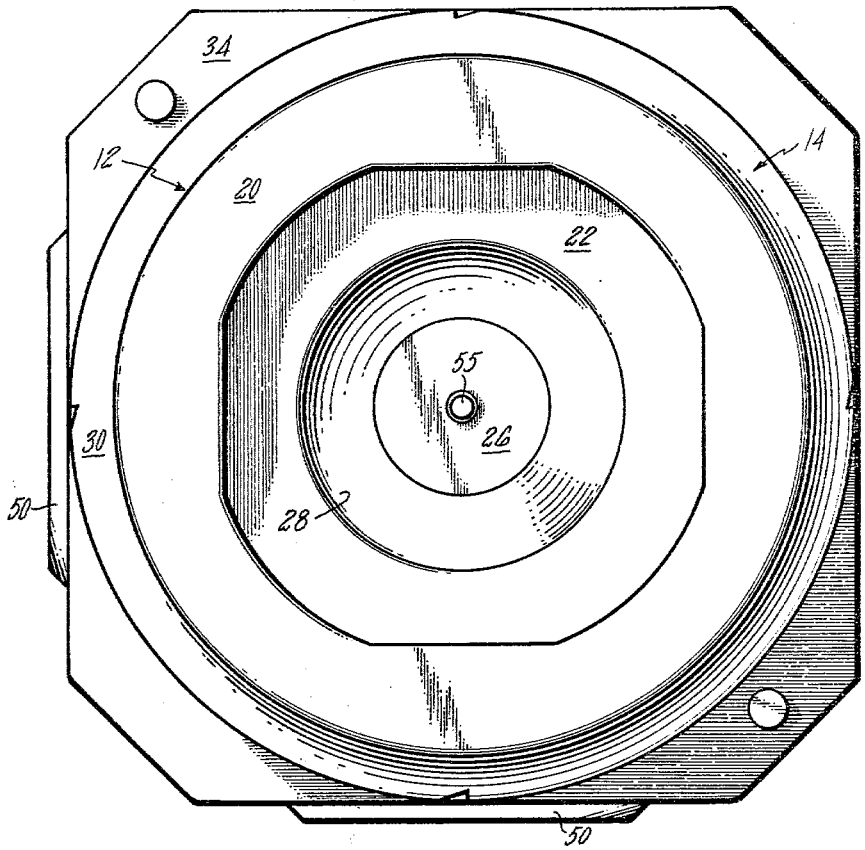
FIG. 3 is a top elevational view of the spool of FIG. 1.
Figure 4:
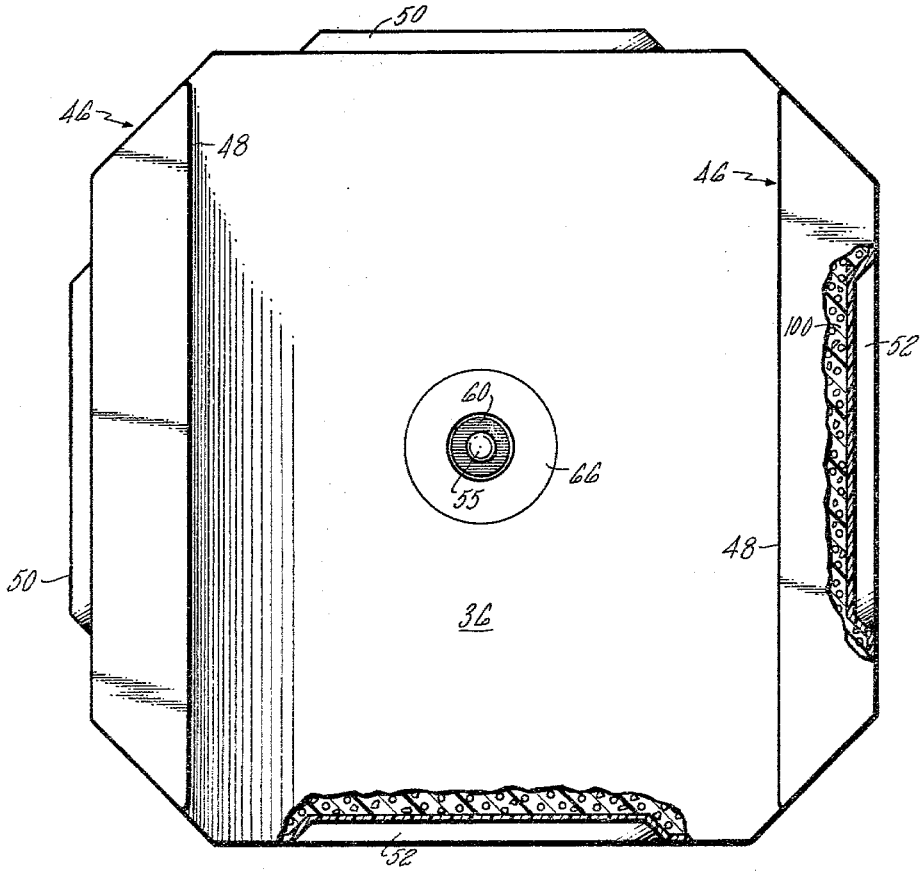
FIG. 4 is a bottom elevational view of the spool of FIG. 1.
Figure 6:
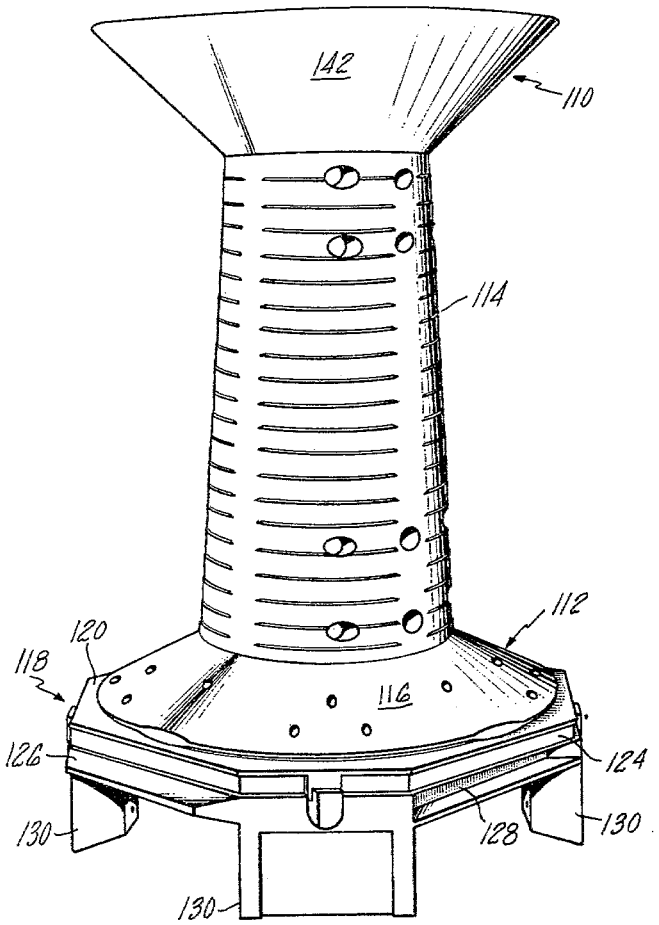
FIGS. 6 through 11 are view of a second embodiment of the spool of the invention.
Figure 7:
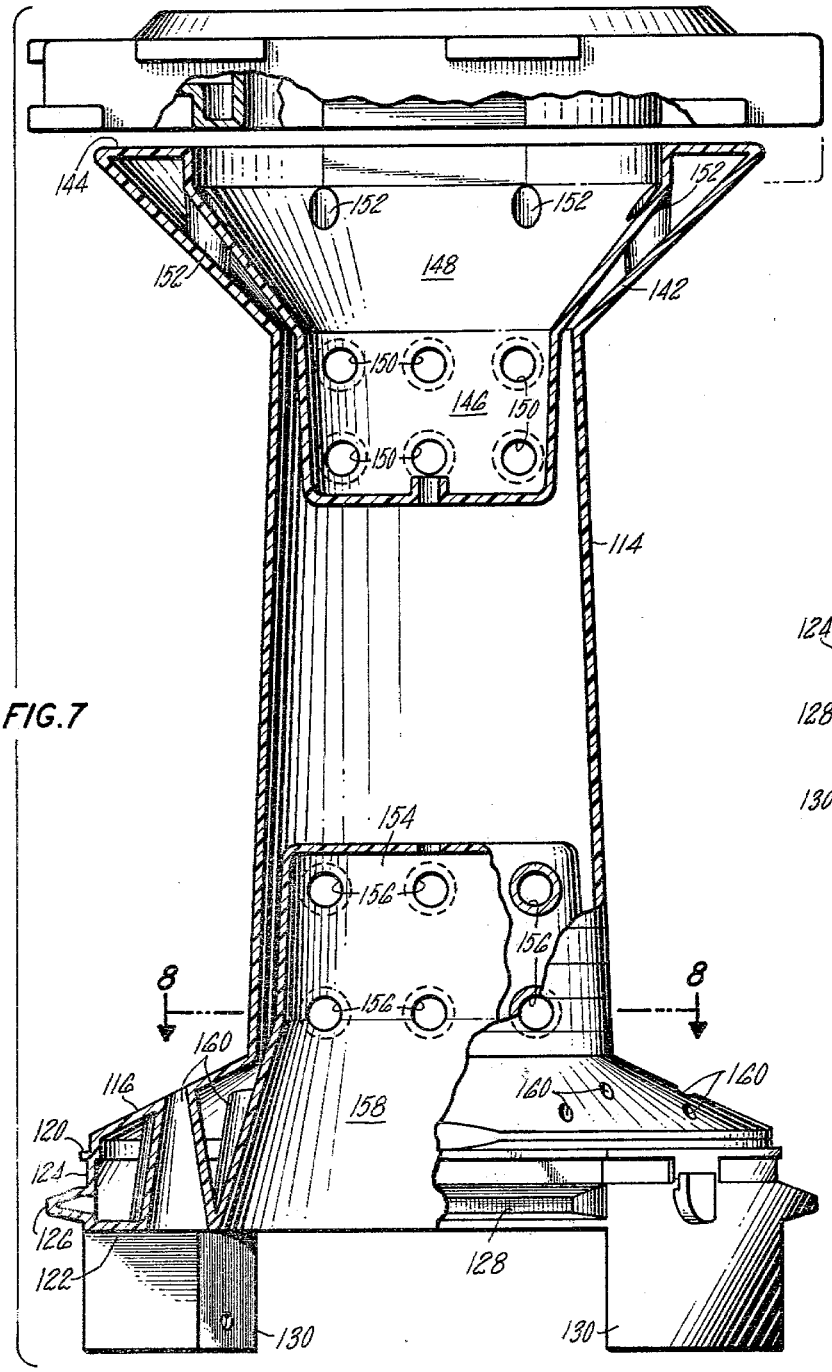
Figure 9:
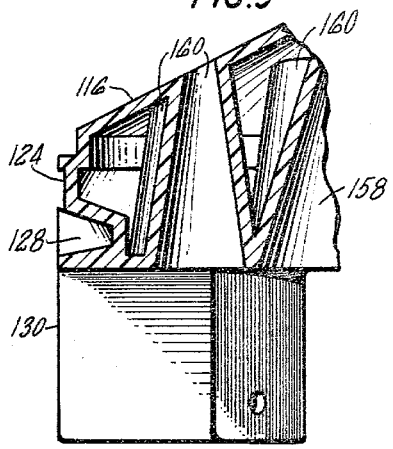
Figure 10:
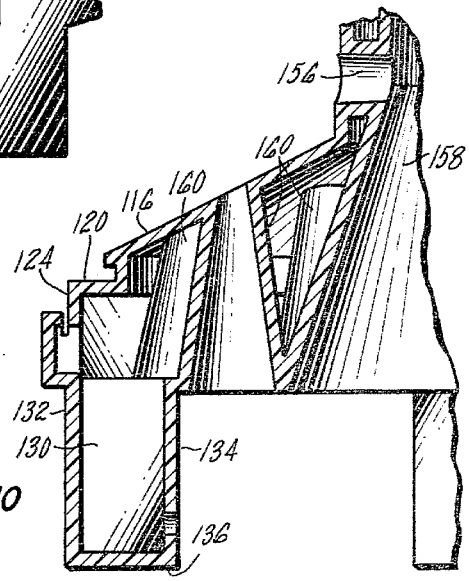
Figure 11:
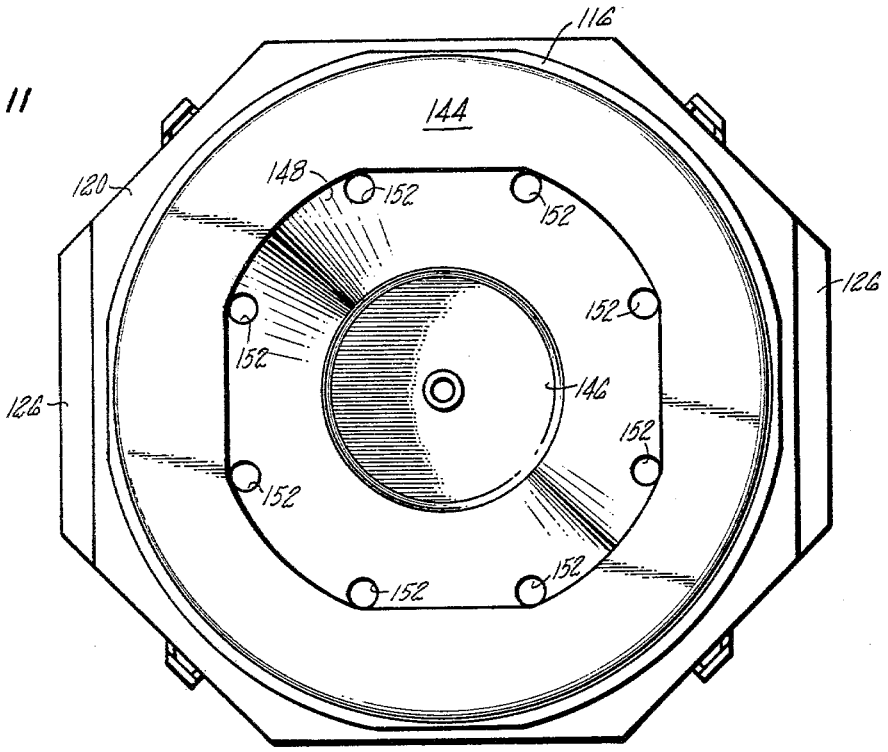
Figure 8:
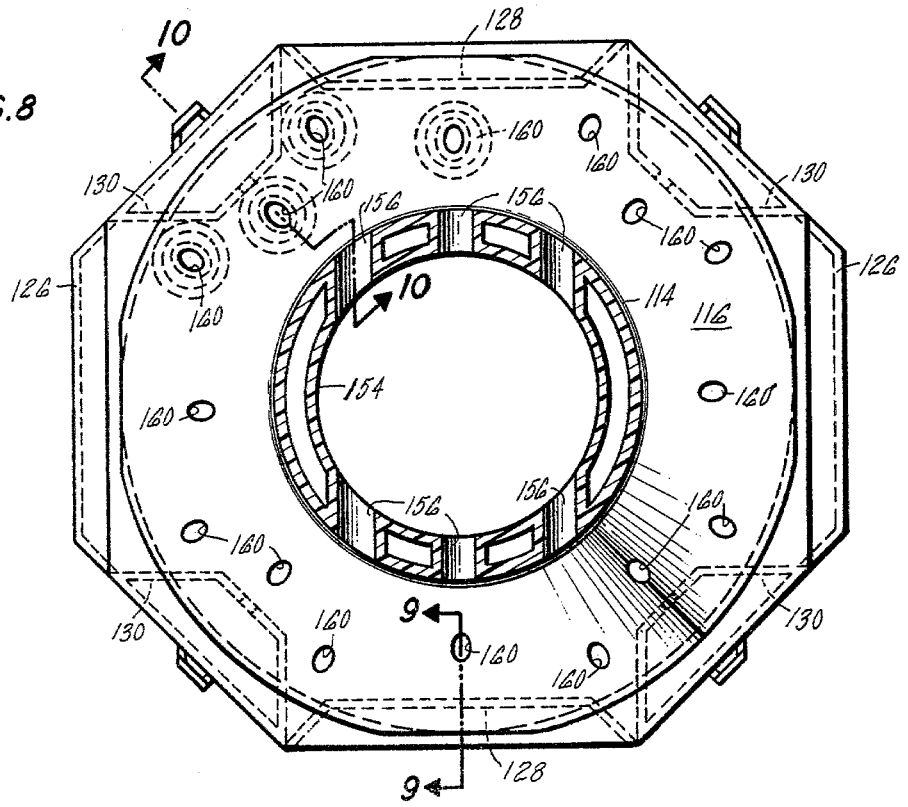

A pair of hollow legs 46 are integral with and extend downwardly from the hollow support platform. The hollow legs 46 are situated at opposite sides of the support platform 32 along the entire length of the sides and are spaced to receive a forklift truck blade therebetween. As shown in FIGS. 1 and 2, each of the four sides of the support platform 32 is formed with interlocking means in the form of either an elongated male tab 50 or a corresponding elongated female recess 52. The male tabs 50 and female tabs 52 are arranged such that a male tab 50 mates with a female recess 52 when two spools are placed in ganged side-by-side relation with their legs parallel to one another. As pointed out above, the spool of the invention can be lifted and transport by a forklift truck. However, the spool of the invention, provides additional means for lifting the spool in the form of a ring 54 by which the spool can be lifted with a pulley or the like. Ring 54 is attached to the end of a rod 55 situated in an axial bore 56 in the spool. The bore 56 is enlarged at its lower end to receive a hollow reinforcing insert 58. As shown in the drawings, rod 55 is attached to the reinforcing insert 58 by suitable means such as a nut 60. Preferably reinforcing insert 58 is a metal casting having a smooth outer surface having a closed upper frustum 62, a straight middle section 64 and a flanged end section 66. The inner wall of the reinforcing insert 58 is substantially the same shape as the outer wall with the exception that the thickness of part of the lower portion wall is greater than the upper wall thickness. An inner shoulder 68 is formed on the reinforcing insert at the transition of the two walls of different thicknesses. Shoulder 68 cooperates with an expandable locking device (not shown) which retains the spool in place during winding and payoff operations.

When a plurality of spools are ganged together in side-by-side relation, each spool has a cap 70 thereon which interlocks with similar caps on adjacent spools as will be hereinafter set forth. The caps 70 are square in configuration and have a central circular opening 72. Surrounding the opening 72 on the underside of cap 70 is a ring like member 74 which cooperates with recess 22 in the spool, while a surrounding recess 76 cooperates with the upper spool flange to retain the cap on the spool. Each cap has a pair of dovetail shaped locking tabs 78 on one of its edges 79 and has a corresponding pair of dovetail shaped recesses 80 on its adjacent edge 81. The other two sides of the cap 82 and 84 each have a plurality of upper guide tabs 86 extending from their upper surface 88 and a plurality of lower guide tabs 90 extending from the lower surface 92 of the cap. It will be seen from the ensuring discussion that tabs 86 and 90 serve as upper and lower guides for a band passed around the outside edges of the caps on adjacent spools. The upper surface of each cap has four raised panels 92 thereon which are spaced to permit stacking of a second spool on top.

Figure 5:
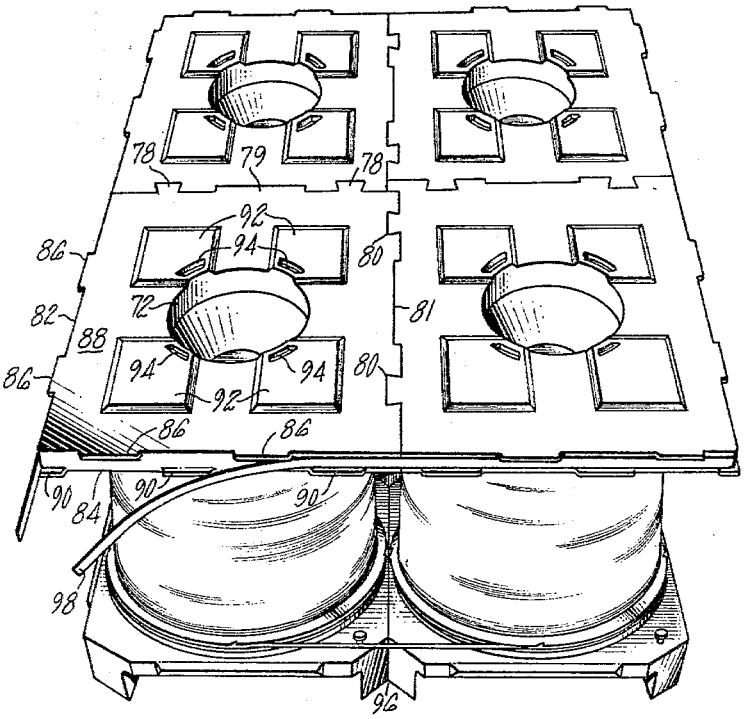
FIG. 5 is a perspective view of a package assembly incorporating four spools and caps in accordance with the present invention.

Four of the above-described spools 10 and caps 70 can be incorporated into a package assembly as shown in FIG. 5. The assembly includes four identical spools in accordance with the invention nested together in ganged side-by-side relation. The spools are oriented such that the male tab 50 of one spool extends into the female tab 52 of an adjacent spool. In addition, each spool has a cap thereon which is interlocked with adjacent caps on adjacent spools. The caps are designed with a relatively tight interference fit between the cap and the upper spool flange but additional retaining means must be provided. Such retaining means could be a plurality of resilient straps (not shown) affixed at one end to ring 54 and at the other end to a recess 94 in the upper surface of the cap.

In the package assembly of the invention, the four ganged spools are held together by a first band 96 applied around the bottom of the spools at the banding recess 40 and by a second band 98 placed around the edges of the four adjacent spool caps.

In order to support substantial weights such as would be encountered if the strand material wound about the spool is wire, it is necessary that the hollow spool be reinforced. Preferably, the reinforcing is a filling of cured plastic foam 100 which occupies the entire interior of the spool, although other reinforcing means may be employed as well. Preferably, the spool is constructed of high density polyethylene and filled with a polyurethane foam although other materials may be chosen for both the shell and the filling.

A second embodiment of the spool of the invention is shown in FIGS. 6–11. This spool differs from the previous embodiment primarily in that the foam reinforcing means of the previous embodiment is replaced by integral braces in the interior of the spool. Secondly, the leg structure of the spool of the second embodiment is different from that of the first embodiment in that the second embodiment has four legs rather than two. Third, the banding recess on the support member is situated below the support platform in the second embodiment rather than above it as in the first embodiment. And finally, the two embodiments differ in their platform configuration, the first embodiment having a square configuration and the second having an octagonal configuration. More specifically, referring to FIG. 6, a spool in accordance with the present invention includes frusto-conical upper and lower flanges 110, and 112, respectively, which are connected together by a tapered hollow barrel 114, lower flange 112 includes a conical frusto-conical wall 116 which is integral with an octagonal support platform 118 consisting of an upper plate 120 and a base plate 122. The sidewalls of the octagonal support platform are each divided into upper and lower sections with the upper section forming a continuous banding groove 124 and the lower section forming a male tab, a female recess or the outside wall of a leg depending upon where the sidewall is located. For example, two opposite sidewalls have a male locating tab 126 on the lower portion with the banding groove 124 being located between the male tab 126 and the lip of upper plate 120. Located ninety degrees from the male tab sidewalls are a pair of sidewalls having a female recess 128 in the lower portion of the platform sidewall. A hollow leg 130 separates the male sidewalls from the female sidewalls. As shown in the drawings, each hollow leg includes an outer wall 132 extending downwardly from the platform sidewall, an inner wall 134 a bottom wall 136 and two end walls 138 and 140, respectively.

The tubular barrel 114 of the second embodiment preferably includes a plurality of stepped segments in the same manner as the first embodiment. The upper flange 110 includes a convex conical wall 142 extending from the top of the barrel and a planar top wall 144 at the end of the conical wall 142.

Reinforcing means for the upper flange 142 includes a hollow cup shaped member 146 situated inside the top of tubular barrel 114, and a reinforcing cone 148 integral with and situated between the cup shaped member 146 and top wall 144. The cup shaped member 146 is attached to barrel 114 by twelve tubular braces 150 (six on each side). Likewise, the reinforcing cone is attached to conical wall 142 by eight tubular braces 152 spaced equidistantly around the periphery of cone 148.

Bottom flange 112 is simlarly reinforced by an inner cup member 154 which is attached to the bottom of barrel 114 by integral tubular braces 156, and an integral reinforcing cone 158 extending between the cup member 156 and base plate 122. Thus, the combination of cone 158, cup member 154 and tubular braces 156 serve to reinforce base place 122. Reinforcement for the conical wall 116 includes a plurality of integral conically shaped tubular braces 160 situated with the enlarged end on the base plate and the small end opening in the surface of wall 116. Accordingly, it will be seen that conical braces 160 serve to reinforce conical wall 116.

The spool of the embodiment of FIGS. 6–10 can be rotationally molded using conventional techniques. Although high density polyethylene is a suitable material, cross linked polyethylene is preferred because of its improved heat resistance.

A spool constructed in accordance with the principles of the invention which is approximately 35 inches in height and 20 inches at the base and a wall thickness of approximately ¼" can support as much as one thousand pounds of magnet type wire wound thereon. In addition, the integral legs allow easy handling by a forklift truck either by itself, or in packages of two or in packages of four. Further, the cap facilitates stacking of the spools, either single or in combination.

What is claimed is:

1. A package assembly for the shipping, storage and handling of wire and analogous strand material, comprising:

a plurality of spool devices each having upright longitudinally extending, tubular, central barrel member and upper and lower flange members carried by said barrel member at the extremities of said barrel member, said lower flange member having a conical disc portion of substantially uniform thickness extending away from said barrel member and having a smooth frusto-conical surface for bearing the weight of strand material wound about said barrel in a plurality of layers generally parallel to the exterior surface of said barrel member;

each said spool device having a support member including hollow supporting legs formed substantially integrally with said spool body as a substantially unitary structure to permit forklift transport of said spool device by itself and in combination with other similar spool devices;

said support member including locating means for locating adjacent spool devices relative to one another when included in ganged side-by-side relation in a package assembly, and a recessed banding groove in said support member for locating and retaining a flexible band encircling and banding together a plurality of spool devices in ganged relation as a package assembly for a single shipping unit;

a cap mounted as the upper flange of each spool device, each said cap including interlock means thereon cooperating with complimentary interlocking means as the cap of an adjacent spool device for preventing separation of adjacent spool devices when in ganged side-by-side relation in a package assembly;

means in the interior of said tubular central barrel member for diametically reinforcing said barrel member; and means in the interior of said support member for reinforcing said conical disc portion to permit the weight of said wire and analogous strand material to be transferred to said hollow supporting legs.

2. The package assembly as claimed in claim 1 wherein said means in the interior of said tubular barrel for diametrically reinforcing said barrel comprises a tubular inner wall inside and substantially parallel to said barrel member and integral reinforcing means extending between said tubular inner wall and said barrel member.

3. The package assembly as claimed in claims 1 or 2 wherein said means in the interior of said support member for reinforcing said conical disc portion comprises a base plate the plane of which is perpendicular to the axis of said spool and second integral reinforcing means extended between said base plate and conical disc portion.

* * * * *